US005584474A

United States Patent [19]

Viechter

[11] Patent Number: 5,584,474

[45] Date of Patent: Dec. 17, 1996

[54] SINGLE SHEET FEED DEVICE FOR AN ELECTROPHOTOGRAPHIC PRINTER OR COPIER

[75] Inventor: Manfred Viechter, Walpetskirchen, Germany

[73] Assignee: Siemens Nixdorf Informationssysteme Aktiengesellschaft, Paderborn, Germany

[21] Appl. No.: 537,832

[22] PCT Filed: Apr. 11, 1994

[86] PCT No.: PCT/DE94/00402

§ 371 Date: Oct. 24, 1995

§ 102(e) Date: Oct. 24, 1995

[87] PCT Pub. No.: WO94/25905

PCT Pub. Date: Nov. 10, 1994

[30] Foreign Application Priority Data

Apr. 29, 1993 [DE] Germany ..... 43 14 158.7

[51] Int. Cl.[6] ..... B65H 5/00

[52] U.S. Cl. ..... 271/3.19; 271/3.2; 271/303; 271/9.12; 271/9.13; 198/447

[58] Field of Search ..... 271/3.18, 3.19, 271/3.2, 9.02, 9.12, 9.13, 302, 304; 355/89; 198/447; 161/93.11; 400/605

[56] References Cited

U.S. PATENT DOCUMENTS

| | | | |
|---|---|---|---|
| 2,251,596 | 8/1941 | O'Malley | 271/303 |
| 3,716,178 | 2/1973 | Shimmin | 271/3.19 |
| 4,179,112 | 12/1979 | Breuers et al. | 271/3.19 |
| 4,208,666 | 6/1980 | Paranjpe | 271/9.12 |
| 4,431,322 | 2/1984 | Nally et al. . | |
| 4,587,532 | 5/1986 | Asano . | |
| 4,727,402 | 2/1988 | Smith . | |
| 5,104,110 | 4/1992 | Haibara | 271/9.02 |

FOREIGN PATENT DOCUMENTS

| | | | |
|---|---|---|---|
| 0104022 | 3/1984 | European Pat. Off. . | |
| 4203265 | 8/1992 | Germany . | |
| 57-019244 | 2/1982 | Japan | 271/3.19 |

OTHER PUBLICATIONS

Patent Abstracts of Japan, vol. 9, No. 144, 19 Jun. 1985, Japanese reference 60–23844 dated 6 Feb. 1985.

IBM Technical Disclosure Bulletin, vol. 22, No. 6, Nov. 1979, K. Sanders, "Two–Path Electrophotographic Print Process", pp. 2465–2466.

Patent Abstracts of Japan, vol. 9, No. 40, 20 Feb. 1985, Japanese reference 59–180568 dated 13 Oct. 1984.

Patent Abstracts of Japan, vol. 15, No. 294, 25 Jul. 1991, Japanese reference 3–106766 dated 7 May 1991.

*Primary Examiner*—H. Grant Skaggs

*Attorney, Agent, or Firm*—Hill, Steadman & Simpson

[57] ABSTRACT

Single sheets A are drawn in the usual way from a first stack 8 of single sheets and conveyed on a first recording carrier conveying path 1. At its end there is a switch 10 which alternately feeds the single sheets A to a second and a third recording carrier conveying path 2, 3. In the second recording carrier conveying path 2 which is in the form of a loop, the single sheets A are shifted sideways by the width of one single sheet. A sideways shifted single sheet A1 and a single sheet A2 which has not been shifted sideways simultaneously reach a fourth recording carrier conveying path 4 on which they are conveyed in pairs to a printing unit D which spans the fourth recording carrier conveying path 4 and conveyed out of it again. Subsequently, one single sheet A1 per pair of single sheets is shifted back by the width of one single sheet in a fifth recording carrier conveying path 5 which is also designed as a loop while the other single sheet A2 is conveyed onwards linearly. The single sheets A successively reach in series a second stack 9 of single sheets and are deposited there.

5 Claims, 2 Drawing Sheets

SINGLE SHEET FEED DEVICE FOR AN ELECTROPHOTOGRAPHIC PRINTER OR COPIER

BACKGROUND OF THE INVENTION

The invention relates to a single sheet feed device for an electrophotographic printer or copier which spans the single sheet feed device. In such printers or copiers, exacting requirements are made of the printing speed. In printers or copiers according to the prior art a printing speed of approximately 50 sheets per minute (for example in the DIN A4 format) is achieved. The single sheets are drawn from a single sheet stack and successively fed by a removal device to a recording carrier conveying path of the single sheet feed device. A printing unit which contains a developer station and a fixing station is arranged in the course of the recording carrier conveying path. A print image is transferred to a single sheet in the developer station and in the fixing station this print image is fixed on the single sheet. In order to ensure sufficient quality of the print image, the development and fixing process can only be accelerated up to a maximum processing speed. A further increase in the processing speed with constant printing quality is consequently not possible by merely increasing the transfer and fixing speed and thus the conveying speed of the single sheets.

U.S. Pat. No. 4,587,532 discloses a sheet feed device and a sheet delivery device which are suitable for feeding single sheets to a plurality of printers operating in synchronism. The single sheets are present in the form of a stack of single sheets. The sheet feed device and the sheet delivery device ensure that a single sheet is fed to each printer at the correct time before the subsequent printing cycle begins and a printed single sheet is conveyed away from said printer. The length of the path and the speed of the sheets are selected appropriately. The feeding speed is higher than the processing speed. However, in order to increase the printing speed a plurality of printing units arranged one on top of the other is required.

U.S. Pat. No. 4,431,322 discloses a printing device with two recording carrier conveying paths which can be selected by means of a switch. Pairs of drive rollers are arranged along the recording carrier conveying paths. These pairs of drive rollers are driven by means of belts. Belt speed-transforming transmission means are provided which can be used to realize different speeds of the pairs of drive rollers. In order to increase the printing speed, two printing units are arranged one on top of the other. Each of the two printing units is assigned a recording carrier conveying path.

U.S. Pat. No. 4,727,402 discloses a single sheet feed device for ordering single sheet information carriers in which single sheets can be drawn off sideways from a stack of single sheets and can be fed to a conveying path in such a way that two single sheets can be conveyed lying one next to the other. The single sheet feed device has a plurality of mechanical and movable individual components, for which reason complex adjustment and frequent maintenance of the single sheet feed device are to be expected.

SUMMARY OF THE INVENTION

The invention is therefore based on the object of disclosing a single sheet feed device for an electrophotographic printer or copier which can be used to increase the number of printed single sheets per time unit with constant printing quality and which has a low number of mechanical and movable individual components so that neither complex adjustment nor frequent maintenance of the single sheet feed device is to be expected.

In general terms the present invention is a single sheet feed device for an electrophotographic printer or copier. A first recording carrier conveying path conveys single sheets serially at first speed which is higher than the processing speed when printing the single sheets. A switch, assigned to the first recording carrier conveying path, selects, as a function of the sequence of sheets, at least one subsequent second or third recording carrier conveying path. The third recording carrier conveying path is arranged as an extension of the first recording carrier conveying path. The second recording carrier conveying path is routed in such a way that a single sheet which passes through this second recording carrier conveying path is shifted sideways by at least the width of one single sheet. The switch contains a flap which couples the first recording carrier conveying path either to the second or to the third recording carrier conveying path. The dwell times of the single sheets in the second and third recording carrier conveying paths are matched to one another in such a way that the single sheets simultaneously reach a printing unit which is arranged downstream, spans the single sheets, conveys at the processing speed and prints the single sheets.

Advantageous developments of the present invention are as follows.

A first conveying means, which is arranged in the first recording carrier conveying path, takes hold of a single sheet and feeds it to the switch at the first speed. The second recording carrier conveying path has at least a third conveying means which conveys the single sheet at a second speed in such a way that a single sheet which is conveyed in the second recording carrier conveying path is always taken hold of by one of the third conveying means. The dwell times of the single sheets in the second and third recording carrier conveying paths are matched to one another in such a way that the front edges of the two single sheets are aligned when a subsequent fourth recording carrier conveying path is reached. A second conveying means which takes hold of both the first and second single sheets when the fourth recording carrier conveying path is reached, conveys them at the processing speed. The first, second and third speeds are twice as high as the processing speed.

In a further embodiment of the present invention the second recording carrier conveying path is designed in a loop-like shape.

In another embodiment of the present invention, a fifth and a sixth recording carrier conveying path are arranged downstream of the fourth recording carrier conveying path in such a way that the first single sheet moves into the fifth recording carrier conveying path and the second single sheet moves into the sixth recording carrier conveying path. The fifth or the sixth recording carrier conveying path is routed in such a way that the first or second single sheet which passes through this fifth or sixth recording carrier conveying path at a fifth speed is shifted back sideways by the width of one single sheet, by the distance which the first single sheet had been shifted in the second recording carrier conveying path. The sixth or fifth recording carrier conveying path is routed in such a way that the second or first single sheet which passes through this sixth or fifth recording carrier conveying path at a sixth speed can be conveyed without sideways shifting. The dwell times of the single sheets in the fifth and sixth recording carrier conveying paths are matched to one another in such a way that the single sheets successively reach a subsequent seventh recording carrier conveying path.

By means of the switch and splitting of the first recording carrier conveying path into a second and a third recording carrier conveying path, two single sheets successively drawn off from a stack of sheets are moved into a position in which they can be processed together in one printing unit. If the processing speed corresponds to a maximum processing speed, the number of printable single sheets per time unit can thus be doubled with uniform printing quality.

By selecting the speeds such that the first, second and third speeds are twice as high as the processing speed, it is ensured that there is an equally large distance between a pair of single sheets conveyed one next to the other in the fourth recording carrier conveying path and the following pair of single sheets as the distance from one single sheet to the following single sheet in the first recording carrier conveying path.

By means of the arrangement of at least a third pair of conveying rollers in the second recording carrier conveying path so that a single sheet which is conveyed in the second recording carrier conveying path is always taken hold of by a pair of conveying rollers it is ensured that the second speed at which the single sheet is conveyed in the second recording carrier conveying path is constant over the entire length of the path. In addition, the pairs of conveying rollers along the second recording carrier conveying path ensure reliable guidance of the single sheet conveyed there.

A loop-like guidance of the second recording carrier conveying path permits, under given spatial conditions, the length of the second recording carrier transport path to be selected precisely so that at a prescribed second speed the front edges of the two single sheets are aligned when the fourth recording carrier conveying path is reached.

The further embodiment and design of the invention according to which a fifth and sixth recording carrier conveying path are assigned downstream of the fourth recording carrier conveying path in such a way that the first single sheet moves into the area of influence of the fifth recording carrier conveying path and the second single sheet moves into the area of influence of the sixth recording carrier conveying path ensure that the paired single sheets are lined up one behind the other in the correct sequence. For this purpose, the fifth or the sixth recording carrier conveying path is routed in a loop-like way such that the first or second single sheet which passes through this recording carrier conveying path at the fifth speed is shifted back sideways by the width of one single sheet, by which distance the first single sheet had been shifted in the second recording carrier conveying path. For this purpose, the sixth or fifth recording carrier conveying path is routed in such a way that the second or first single sheet which passes through this recording carrier conveying path at a sixth speed can be conveyed without sideways shifting. By selecting the dwell times of these single sheets in the fifth and sixth recording carrier conveying path in such a way that the two single sheets successively reach a subsequent seventh recording carrier conveying path, the original distance from single sheet to single sheet of the first recording carrier conveying path is restored. Successive stacking of the single sheets in the correct sequence is thus ensured. This is not disadvantageous in terms of operation for an operator who prepares the stack of single sheets and removes the printed single sheets from the printer or copier. If forms which are ordered for example in a specific sequence are to be processed in the printer or copier, then this does not give rise to any additional work for the operator because of the design of the printer or copier according to the invention.

BRIEF DESCRIPTION OF THE DRAWINGS

The features of the present invention which are believed to be novel, are set forth with particularity in the appended claims. The inventory, together with further objects and advantages, may best be understood by reference to the following description taken in conjunction with the accompanying drawings, in the several Figures of which like reference numerals identify like elements, and which:

DESCRIPTION OF THE PREFERRED EMBODIMENTS

Figure 1:
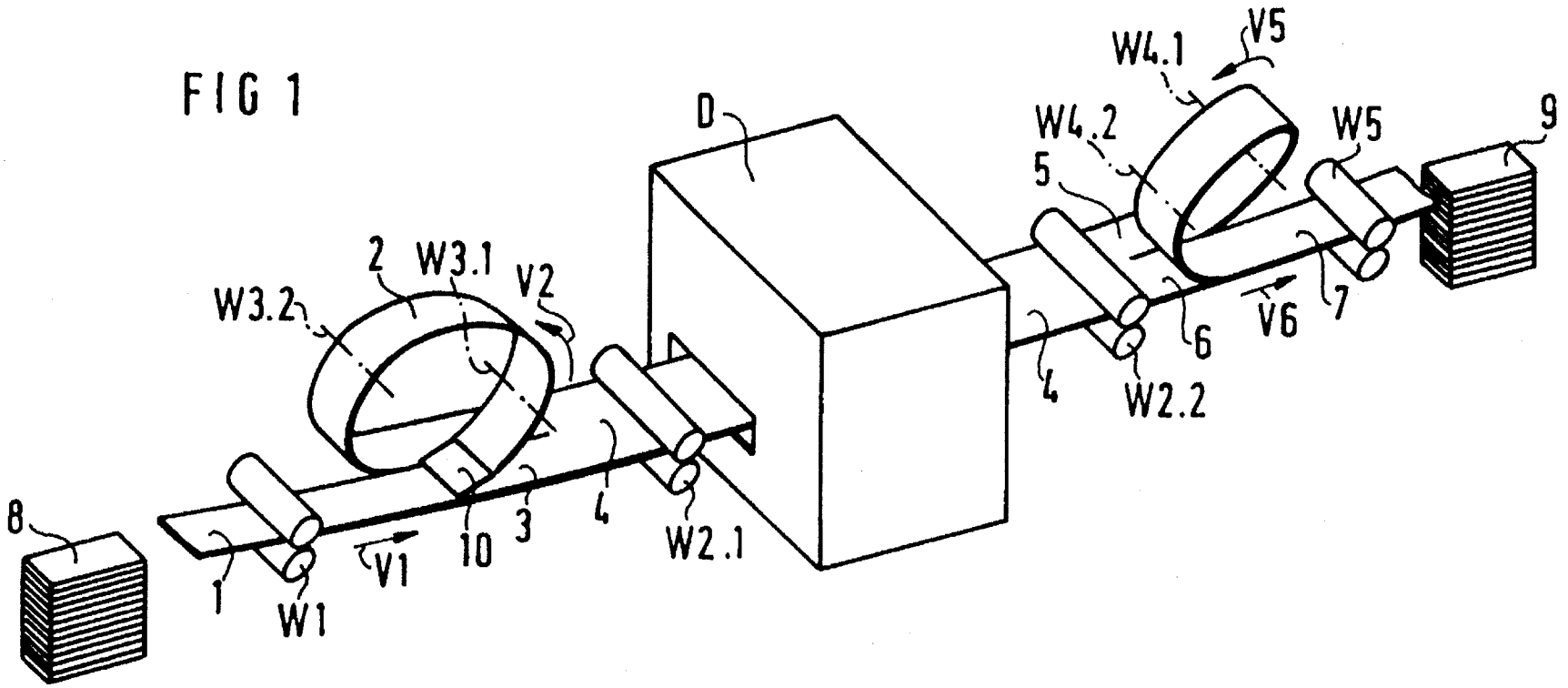
FIG. 1 shows a diagrammatic, spatial illustration of a single sheet feed device for branching a recording carrier conveying path.
Figure 2:
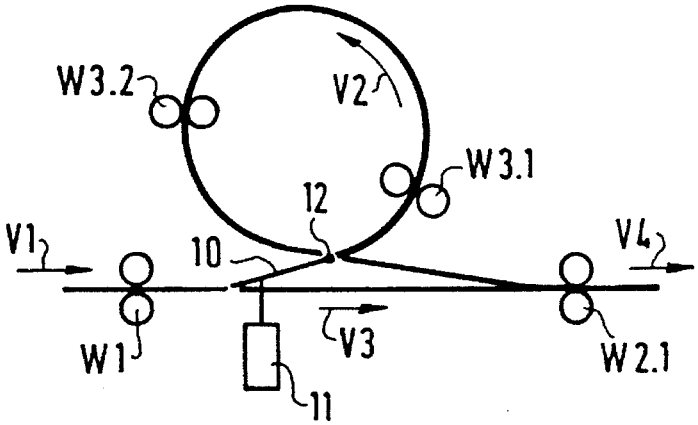
FIG. 2 shows a detail, containing a loop-like switch, of the single sheet feed device according to FIG. 1

The single sheet feed device illustrated in FIG. 1 in which a recording carrier conveying path is branched contains a first recording carrier conveying path 1 on which single sheets A which are drawn from a first stack 8 of single sheets can be conveyed to a switch 10 arranged at the end of the first recording carrier conveying path 1. The single sheets A are taken hold of by a first pair W1 of conveying rollers on the first recording carrier conveying path 1 and conveyed by friction at a first speed V1 (see FIG. 2).

The switch 10 directs an incoming single sheet A either to a second recording carrier conveying path 2 which is routed in a loop-like way or to a third recording carrier conveying path 3 which linearly extends the first recording carrier conveying path 1. For this purpose, the switch 10 contains a flap which can pivot about an axis 12. The axis 12 runs transversely with respect to the direction in which the recording carrier is conveyed. The deflection of the flap of the switch 10 into a first position in which an incoming single sheet A is fed to the second recording carrier conveying path 2 and into a second position in which an incoming single sheet A is fed to the third recording carrier conveying path 3 is carried out by means of a switchover means which is constructed as a solenoid actuator 11. An electromotive or pneumatic drive is also suitable as switchover means 11.

When a single sheet A moves into the second recording carrier conveying path 2, then this single sheet A is taken hold of by one, of a total of two, third pairs W3.1 of conveying rollers. This third pair W3.1 of conveying rollers conveys the single sheet A by means of friction into the loop-like arrangement of the second recording carrier conveying path 2 at a second speed V2. In general, for precise guidance of the single sheet A on the second recording carrier conveying path 2 it is sufficient to align the axes of rotation of the third pairs W3.1, W3.2 of conveying rollers at a right angle with respect to the direction in which the recording carriers are conveyed. However if it is desired to align an edge of the single sheets A along a run up edge provided at the lateral edge of the second recording carrier conveying path 2, the axes of rotation of the third pairs W3.1, W3.2 of conveying rollers are to be positioned in such a way that the single sheets A are moved slightly towards the run up edge.

The third pairs W3.1, W3.2 of conveying rollers are arranged along the second recording carrier conveying path 2 at such a distance from one another that a single sheet A1 which is conveyed in the second recording carrier conveying path 2 is always taken hold of by at least one of the third pairs W3.1, W3.2 of conveying rollers. As a result it is ensured that the conveyed single sheet A1 is always guided precisely and conveyed at exactly the second speed V2.

While being conveyed in the second recording carrier conveying path 2, the conveyed single sheet A1 describes the helical line of a screw thread. The pitch of the thread is selected here such that the single sheet A1 is shifted, after passing through the second recording carrier conveying path 2, by at least one width of a single sheet with respect to the first recording carrier conveying path 1. The diameter of the thread is selected such that the dwell time of the single sheet A1, conveyed at the second speed V2, in the second recording carrier conveying path 2 is so long that the front edge of the single sheet A1 conveyed in the second recording carrier conveying path 2 reaches a fourth recording carrier conveying path 4, following the second and third recording carrier conveying paths 2, 3, at the same time as the front edge of a single sheet A2 conveyed on the third recording carrier conveying path 3.

On the third recording carrier conveying path, in each case a single sheet A is conveyed which, on the first recording carrier conveying path 1, followed a single sheet A which was fed to the second recording carrier conveying path 2 by the switch 10. A single sheet A2 which is conveyed on the third recording carrier conveying path 3 is conveyed there at a third speed V3. Because of the small length of the third recording carrier conveying path 3, according to the exemplary embodiment a pair of conveying rollers can be dispensed with in the third recording carrier conveying path 3. However, it is also possible to introduce a pair of conveying rollers in this third recording carrier conveying path 3 if this should be necessary.

When the fourth recording carrier conveying path 4 is reached, the single sheets A1, A2 coming from the second and third recording carrier conveying paths 2, 3 are taken hold of by one of the second pairs W2.1 of conveying rollers arranged along the [lacuna] and fed by friction to a printing unit D which spans the fourth recording carrier conveying path 4. In the printing unit D, a print image is transferred onto the single sheets A in a developer station contained there and fixed in a fixing station also contained in the printing unit D. After fixing of the print image has taken place, the single sheets A leave the printing unit D again. The single sheets A are fed by friction along the fourth recording carrier conveying path 4 on which they are taken hold of by a further second pair W2.2 of conveying rollers to two subsequent recording carrier conveying paths 5, 6.

The fifth and sixth recording carrier conveying paths 5, 6 which follow the fourth recording carrier conveying path 4 are, like the second and third recording carrier conveying paths 2, 3, each half as wide as the fourth recording carrier conveying path 4. They are arranged one next to the other and can thus in each case pick up one of two single sheets A conveyed one next to the other from the fourth recording carrier conveying path 4. The fifth recording carrier conveying path 5 into which those single sheets are moved which have passed through the second recording carrier conveying path 2 before the fourth recording carrier conveying path 4 is reached is also routed in a loop-like form, like the second recording carrier conveying path 2. The pitch, diameter and length of this fifth recording carrier conveying path correspond to those of the second recording carrier conveying path 2. In the fifth recording carrier conveying path 5, as in the second recording carrier conveying path 2, two pairs W4.1, W4.2 of conveying rollers are arranged. These fourth pairs W4.1, W4.2 of conveying rollers ensure that the single sheet A1 conveyed on the fifth recording carrier conveying path 5 is guided precisely and that it maintains the desired speed.

The sixth recording carrier conveying path 6 extends linearly one half of the fourth recording carrier conveying path 4. In the sixth recording carrier conveying path 6 a pair of conveying rollers (not illustrated) is arranged which accelerates the single sheet A2 present in the sixth recording carrier conveying path 6 to a sixth speed V6 and feeds it to a subsequent seventh recording carrier conveying path 7. In the seventh recording carrier conveying path 7 an incoming single sheet A1, A2 is taken hold of by a fifth pair W5 of conveying rollers and fed to a second stack 9 of single sheets at the sixth speed V6.

The ends of the fifth and sixth recording carrier conveying paths 5, 6 both lie, viewed in the direction in which the recording carriers are conveyed, opposite the start of the seventh recording carrier conveying path 7. A single sheet A1 which comes from the fifth recording carrier conveying path 5 is fed obliquely from above to the seventh recording carrier conveying path 7 and a single sheet A2 which comes from the sixth recording carrier conveying path 6 is fed linearly to the seventh recording carrier conveying path 7.

Figure 3:
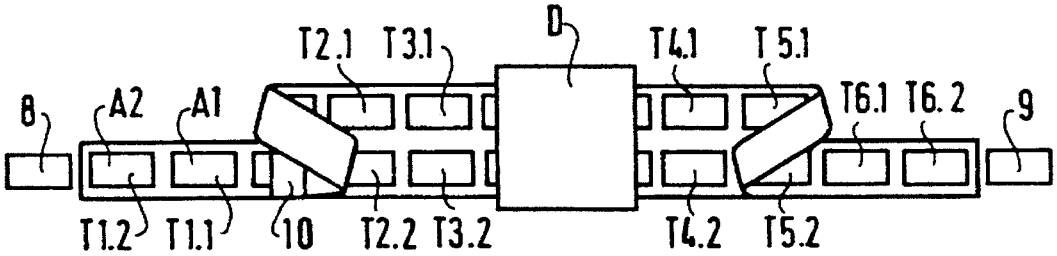
FIG. 3 shows a top view of a chronological sequence of single sheets according to FIG. 1.

With reference to FIG. 3, the position of a pair of single sheets A1, A2 at different times T1 to T6 is presented below. After the single sheets A1, A2 from the first stack 8 of single sheets have been successively fed to the first recording carrier conveying path 1, the first single sheet A1 is located, at the first time T1.1, in front of the second single sheet A2 which follows the first single sheet A1 at a small distance at the same first time T1.2. The single sheets A1, A2 are conveyed at the first speed V1 to the switch 10 in the direction in which the recording carriers are conveyed. When the first single sheet A1 arrives at the flap of the switch 10, this flap is pivoted downward about the axis 12 in such a way that the first single sheet A1 is carried via the switch into the second recording carrier conveying path 2. There, the first single sheet A1 is successively taken hold of by the third pairs W3.1, W3.2 of conveying rollers and carried in a helical line shape to the fourth recording carrier conveying path 4.

After the first single sheet A1 has passed the switch 10, the solenoid actuator 11 pivots the flap of the switch 10 upward about the axis 12. As a result, the second single sheet A2 which follows the first single sheet A1 does not move onto the second, but rather onto the third recording carrier conveying path 3, Its length is so short that at a second time T2.1, T2.2 both the first single sheet A1 and the second single sheet A2 reach the fourth recording carrier conveying path 4 lying one next to the other with their front edges aligned. In this recording carrier conveying path 4, the pair A1, A2 of single sheets are taken hold of by a second pair W2.1 of conveying rollers and conveyed at the processing speed V4 into the printing unit D in the direction in which the recording carriers are conveyed. A further second pair W2.2 of conveying rollers which take hold of the pair A1, A2 of single sheets and convey them onwards at the processing speed V4 on the fourth recording carrier conveying path 4 in the direction in which the recording carriers are conveyed are arranged downstream of the printing unit D. At the third time T3.1, T3.2, the single sheets A1, A2 are located in front of the printing unit D, and at the fourth time T4.1, T4.2 they are located behind it.

If the first, second, third speeds and the processing speeds, V1, V2, V3, V4 were exactly equal, a distance of the length of one single sheet A would arise between the pairs of single sheets A conveyed on the fourth recording carrier conveying path 4. This enlargement of the distance between the single sheets A1 would reduce the number of single sheets A which can be printed per time unit. An enlarged distance between the single sheets A can however be avoided according to the invention in that the processing speed V4 is smaller than the first, second and third speeds V1, V2, V3 and in an extreme case is halved.

Starting from the position at the fourth time T4.1, T4.2, the single sheet A1 reaches the fifth recording carrier conveying path 5 and the second single sheet A2 reaches the sixth recording carrier conveying path 6. At the fifth time T5.1, T5.2, the single sheets A1, A2 are already in the aforesaid recording carrier conveying paths 5, 6. In these recording carrier conveying paths 5, 6, the single sheets A1, A2 are conveyed at a fifth and at a sixth speed V5, V6. The fifth and sixth speeds V5, V6 are twice as high as the processing speed V4. As a result the single sheets A which are fed in in pairs are successively conveyed away so quickly that there can be no blockage of single sheets.

Since the sixth recording carrier conveying path 6 is substantially shorter than the fifth recording carrier conveying path 5 which is of loop-like design, the second single sheet A2 reaches the seventh recording carrier conveying path 7 first, and when the single sheet A1 arrives it is already conveyed so far that the two single sheets A1, A2 do not touch. At the sixth time T6.1, T6.2, both single sheets A1, A2 are located completely on the seventh recording carrier conveying path 7 and are subsequently successively deposited on the second stack 9 of single sheets.

In the exemplary embodiment described, the sequence of single sheets A which are conveyed in pairs is respectively inverted, i.e. a single sheet A1 which is conveyed in front of a second single sheet A2 in the first recording carrier conveying path I is located behind the second single sheet A2 on the seventh recording carrier conveying path 7. However, this is not generally a problem since the single sheets are usually unprinted before passing through the printing unit D. However if the stacking sequence such as is present in the first stack 8 of single sheets has to be reproduced again when stacking sheets into the second stack 9 of single sheets, all that is necessary is to interchange the fifth and sixth recording carrier conveying paths 5, 6. The stacking sequence has to be maintained for example when printing forms. Instead of the pairs W of conveying rollers, conveying belts or a tractor drive can also be used. This has no influence on the subject matter of the invention.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A single sheet feed device for an electrophotographic printer or copier for conveying single sheets to and from a printing unit having a processing speed for printing the single sheets, comprising:

a first recording carrier conveying path which conveys the single sheets serially at a first speed which is higher than the processing speed of the printing unit when printing the single sheets;

a switch, assigned to the first recording carrier conveying path, for selecting, as a function of sequence of sheets, at least one of subsequent second and third recording carrier conveying paths;

the third recording carrier conveying path being arranged as an extension of the first recording carrier conveying path;

the second recording carrier conveying path being routed such that a single sheet which passes through the second recording carrier conveying path is shifted sideways by at least a width of one single sheet;

the switch having a flap which couples the first recording carrier conveying path either to the second recording carrier conveying path or to the third recording carrier conveying path; and dwell times of first and second single sheets in the second and third recording carrier conveying paths, respectively, being matched to one another such that the first and second single sheets simultaneously reach the printing unit which is arranged downstream, which spans the first and second single sheets, which conveys the first and second single sheets at the processing speed and which prints the first and second single sheets.

2. The single sheet feed device as claimed in claim 1, wherein the single sheet feed device further comprises:

a first conveying device which is arranged in the first recording carrier conveying path and which takes hold of a single sheet and which feeds the single sheet to the switch at the first speed;

in the second recording carrier conveying path at least one third conveying device which conveys a single sheet at a second speed such that the single sheet which is conveyed in the second recording carrier conveying path is always taken hold of by one of the third conveying devices;

the dwell times of the first and second single sheets in the second and third recording carrier conveying paths, respectively, being matched to one another such that front edges of the first and second single sheets are aligned when a subsequent fourth recording carrier conveying path is reached; and a second conveying device which takes hold of both the first and second single sheets when the fourth recording carrier conveying path is reached and conveys them at the processing speed.

3. The single sheet feed device as claimed in claim 2, wherein in the third conveying path single sheets are conveyed at a third speed and wherein the first, second and third speeds are twice as high as the processing speed.

4. The single sheet feed device as claimed in claim 2, wherein the single sheet feed device further comprises:

a fifth recording carrier conveying path and a sixth recording carrier conveying path that are arranged downstream of the fourth recording carrier conveying path such that the first single sheet moves into the fifth recording carrier conveying path and the second single sheet moves into the sixth recording carrier conveying path;

one of the fifth and the sixth recording carrier conveying paths being routed such that one of the first and second single sheets, which passes through this recording carrier conveying path at a fifth speed, is shifted back sideways by the width of one single sheet, and by the distance which the first single sheet had been shifted in the second recording carrier conveying path;

the other of the sixth and fifth recording carrier conveying paths being routed such that the other of the second and first single sheets which passes through this recording carrier conveying path at a sixth speed is conveyed without sideways shifting; and dwell times of the first and second single sheets in the fifth and sixth recording carrier conveying paths being matched to one another such that the first and second single sheets successively reach a subsequent seventh recording carrier conveying path.

5. The single sheet feed device as claimed in claim 1, wherein the second recording carrier conveying path is designed in a loop-like shape.

* * * * *